US010865350B2

(12) United States Patent
Jimenez et al.

(10) Patent No.: US 10,865,350 B2
(45) Date of Patent: Dec. 15, 2020

(54) PROCESS FOR HYDROPROCESSING A HYDROCARBON STREAM

(71) Applicant: UOP LLC, Des Plaines, IL (US)

(72) Inventors: Alexander C. Jimenez, Hoffman Estates, IL (US); Michael R. Smith, Rolling Meadows, IL (US); Trung Pham, Mount Prospect, IL (US); Edward J. Houde, Woodstock, IL (US)

(73) Assignee: UOP LLC, Des Plaines, IL (US)

( * ) Notice: Subject to any disclaimer, the term of this patent is extended or adjusted under 35 U.S.C. 154(b) by 285 days.

(21) Appl. No.: 15/721,887

(22) Filed: Sep. 30, 2017

(65) Prior Publication Data

US 2019/0100704 A1 Apr. 4, 2019

(51) Int. Cl.

| | |
|---|---|
| ***C10G 65/14*** | (2006.01) |
| ***C10G 69/04*** | (2006.01) |
| ***C10G 45/04*** | (2006.01) |

(52) U.S. Cl.

CPC ..... *C10G 65/14* (2013.01); *C10G 45/04* (2013.01); *C10G 69/04* (2013.01); *C10G 2300/202* (2013.01); *C10G 2300/205* (2013.01); *C10G 2300/708* (2013.01)

(58) Field of Classification Search

None

See application file for complete search history.

(56) References Cited

U.S. PATENT DOCUMENTS

| | | | | |
|---|---|---|---|---|
| 3,598,535 | A | 8/1971 | Wennerberg | |
| 8,632,673 | B2 | 1/2014 | Kressmann et al. | |
| 2004/0055934 | A1 | 3/2004 | Tromeur et al. | |
| 2012/0091039 | A1 | 4/2012 | Fang et al. | |
| 2014/0001089 | A1* | 1/2014 | Bazer-Bachi | C10G 65/04 208/57 |
| 2015/0274611 | A1* | 10/2015 | Zhu | C10G 45/44 585/315 |

FOREIGN PATENT DOCUMENTS

| | | | |
|---|---|---|---|
| FR | 2681871 | A1 | 4/1993 |
| FR | 2784687 | A1 | 4/2000 |

* cited by examiner

*Primary Examiner* — Derek N Mueller

(74) *Attorney, Agent, or Firm* — Paschal & Associates, LLC; James C. Paschall

(57) ABSTRACT

A process and apparatus provides alternative hydrotreating reactor trains for hydrotreating a hydrocarbon stream. One hydrotreating reactor train is smaller than the other and the smaller train comes on stream to allow replacement or regeneration of catalyst in the larger train. A sulfide system also sulfides the catalyst volume in the reactor train that is off stream to prepare it for renewed hydroprocessing of feed when back on stream. The process and apparatus can be used to keep hydroprocessing reactors on stream to continuously provide feed to an FCC unit which has a longer period before shut down.

11 Claims, 1 Drawing Sheet

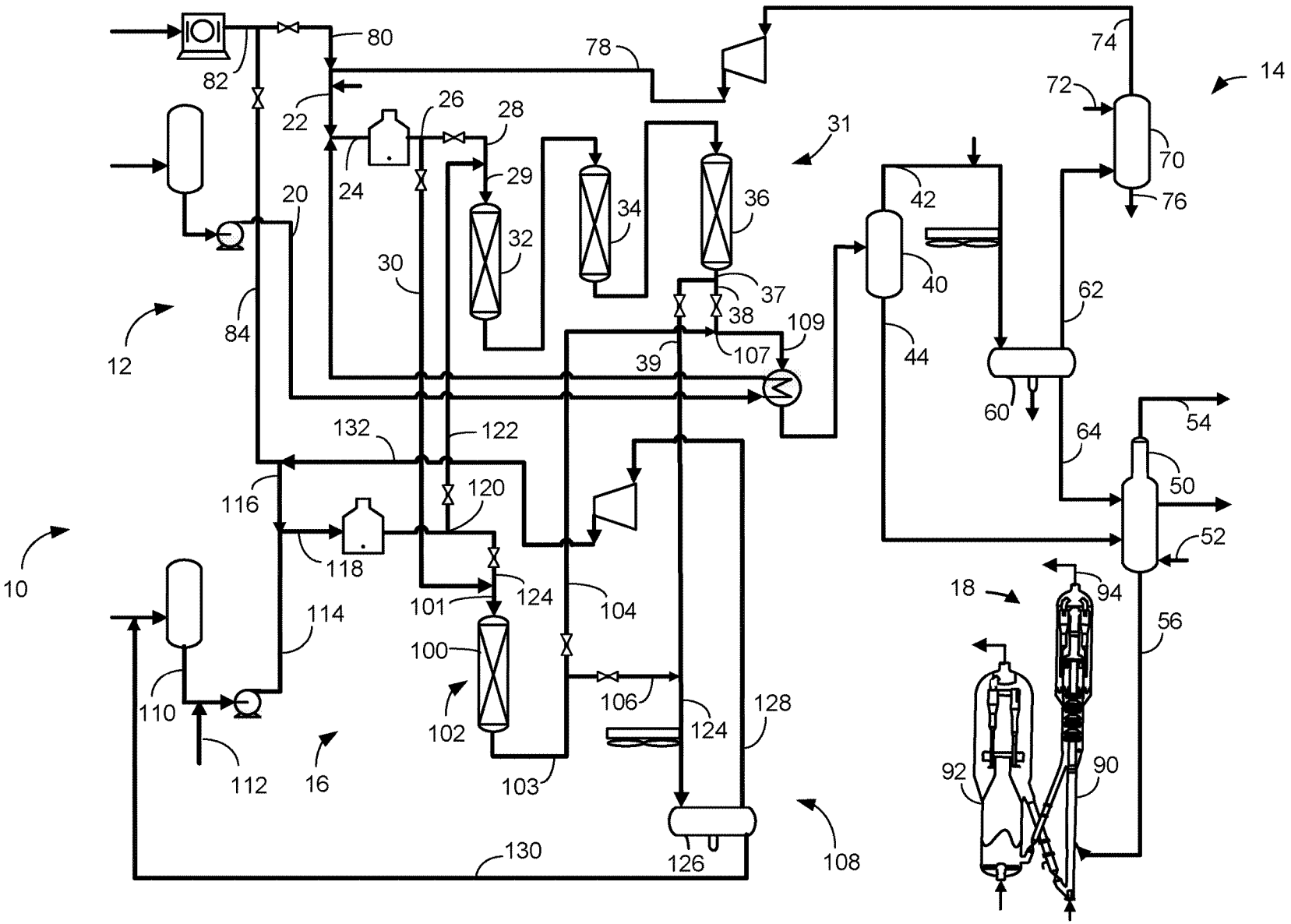
14
70
76
74
72
62
64
54
50
52
56
94
90
60
18
92
42
40
44
31
109
107
37
36
38
39
34
78
28
29
32
26
30
24
80
22
20
82
84
12
10
108
128
124
126
106
104
103
130
122
120
101
100
102
132
118
114
116
16
112
110

PROCESS FOR HYDROPROCESSING A HYDROCARBON STREAM

FIELD

The field is the hydroprocessing of hydrocarbon streams. Particularly, the field relates to hydrotreating of residue streams for catalytic cracking.

BACKGROUND

Hydroprocessing includes processes which convert hydrocarbons in the presence of hydroprocessing catalyst and hydrogen to more valuable products. Hydrotreating is a process in which hydrogen is contacted with a hydrocarbon stream in the presence of hydrotreating catalysts which are primarily active for the removal of heteroatoms, such as sulfur, nitrogen and metals, such as iron, nickel, and vanadium and asphaltenes from the hydrocarbon feedstock.

Residue or resid streams are produced from the bottom of a fractionation column. Resid hydrotreating is a hydrotreating process to remove metals, sulfur and nitrogen and asphaltenes from an atmospheric residue (AR) or a vacuum residue (VR) feed, so that it can be cracked to valuable fuel products.

Hydrotreating of resid streams requires high severity. Resid hydrotreating units typically have hydrodemetallization (HDM) catalyst up front, followed by hydrodesulfurization (HDS) catalyst to remove high concentrations of metals and sulfur from resid streams.

The fluid catalytic cracking (FCC) process comprises a reactor that is closely coupled with a regenerator, followed by downstream hydrocarbon product separation. Hydrocarbon feed such as resid feed contacts catalyst in the reactor to crack the hydrocarbons down to smaller molecular weight products. During this process, coke tends to accumulate on the catalyst which is burned off in the regenerator.

Resid hydrotreating units are typically installed upstream of an FCC unit to demetallize and desulfurize the resid stream to prepare the resid feed for the FCC unit. FCC units can typically operate for five years between shut downs for maintenance. Resid hydrotreating units typically require shut down every year to change out the hydrotreating catalyst which deactivates rapidly due to the high concentrations of metals and sulfur in the resid feed. Consequently, while the FCC unit is ready for feed, it does not operate at full capacity and typically much lower than full capacity while the resid hydrotreating unit is shut down for maintenance four times during the FCC period of operation. This incongruence denies refiners full operational and economic potential.

It would be highly desirable to have a hydrotreating process that can hydroprocess resid feed for an FCC unit for the entire period that the FCC unit is operational between shut downs.

SUMMARY

The subject process and apparatus provides alternative hydrotreating reactor trains for hydrotreating a hydrocarbon stream. One hydrotreating reactor train is smaller than the other reactor train but both may operate at the same capacity. The smaller reactor train comes on stream to allow the larger reactor train to go off stream for replacement or regeneration of catalyst. A sulfide system also sulfides the catalyst volume in the reactor train that is off stream to prepare it for renewed hydroprocessing of feed when back on stream.

BRIEF DESCRIPTION OF THE DRAWING

The FIGURE is a schematic drawing of an alternate-train hydroprocessing unit.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of the bottoms stream back to the bottom of the column. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns omit a reboiler at a bottom of the column and instead provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-7169.

As used herein, the term "T5", "T70" or "T95" means the temperature at which 5 mass percent, 70 mass percent or 95 mass percent, as the case may be, respectively, of the sample boils using ASTM D-7169.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at lower pressure.

DETAILED DESCRIPTION

The subject process and apparatus ensures continuous hydrotreatment of feed for provision of feed to an FCC reactor. The apparatus and process 10 for hydroprocessing and/or converting a hydrocarbon stream comprises a first reactor train 12, a separation section 14, a second reactor train 16, an FCC unit 18 and a sulfiding section 108. Operation alternates between a first condition in which the first reactor train 12 is on stream and the second reactor train 16 is off stream and a second condition in which the second reactor train 16 is on stream and the first reactor train is off stream. In the first condition, the second reactor train 16 can undergo catalyst replacement or regeneration and sulfidation and in the second condition, the first reactor train 12 can undergo catalyst replacement or regeneration and sulfidation.

A hydrocarbon stream in a feed line 20 from a first surge drum may be heat exchanged with reactor effluent and mixed with a hydrogen stream in a mixed hydrocarbon feed line 22. A mixed hydrocarbon stream in mixed hydrocarbon line 24 may be passed to a charge heater and divided at a hydrocarbon split 26. The hydrocarbon split 26 joins the mixed hydrocarbon feed line 22 to a first hydrocarbon feed line 28 and a second hydrocarbon feed line 30. The process and apparatus 10 can be alternately operated in a first condition and a second condition. In the first condition, a control valve on the first hydrocarbon feed line 28 is open to allow the mixed hydrocarbon stream to enter a first train inlet line 29 to the first reactor train 12 comprising a first catalyst volume 31, and a control valve on the second hydrocarbon feed line 30 is closed to prevent the mixed hydrocarbon stream from entering the second reactor train inlet line 101. In the second condition, a control valve on the second hydrocarbon feed line 30 is open to allow the mixed hydrocarbon stream to enter a second train inlet line 101 to the second reactor train 16 comprising a second catalyst volume 102, and a control valve on the first hydrocarbon feed line 28 is closed to prevent the mixed hydrocarbon feed from entering the first reactor train inlet line 29. A stream of water may be added to the mixed hydrocarbon stream in the mixed hydrocarbon feed line 22.

In one aspect, the process and apparatus described herein are particularly useful for hydrotreating a hydrocarbon feed stream comprising a resid hydrocarbonaceous feedstock. A resid feedstock may be taken from a bottom of an atmospheric fractionation column or a vacuum fractionation column. A suitable resid feed is AR having an T5 between about 316° C. (600° F.) and about 399° C. (750° F.) and a T70 between about 510° C. (950° F.) and about 704° C. (1300° F.). VR having a T5 in the range between about 482° C. (900° F.) and about 565° C. (1050° F.) may also be a suitable feed. VR, atmospheric gas oils having T5 between about 288° C. (550° F.) and about 315° C. (600° F.) and vacuum gas oils (VGO) having T5 between about 316° C. (600° F.) and about 399° C. (750° F.) may also be blended with the AR to make a suitable resid feed. Deasphalted oil, visbreaker bottoms, clarified slurry oils, and shale oils may also be suitable resid feeds alone or by blending with AR or VR.

Typically, these resid feeds contain a significant concentration of metals which have to be removed before catalytic desulfurization can occur because the metals will adsorb on the HDS catalyst making it inactive. Typically, suitable resid feeds include about 50 to about 500 wppm metals but resid feeds with less than about 200 wppm metals may be preferred. Nickel, vanadium and iron are some of the typical metals in resid feeds. Resid feeds may comprise about 5 to about 200 wppm nickel, about 50 to about 500 wppm vanadium, about 1 to about 150 wppm iron and/or about 5 to about 25 wt % Conradson carbon residue. Resid feeds may comprise about 10,000 wppm to about 60,000 wppm sulfur. Frequently refiners have a targeted product specification depending on downstream application of hydrotreated products, primarily on sulfur and metal content.

Hydrotreating is a type of hydroprocessing wherein hydrogen is contacted with hydrocarbon in the presence of hydrotreating catalysts which are primarily active for the removal of heteroatoms, such as sulfur, nitrogen, metals and asphaltenes from the hydrocarbon feedstock. The first reactor train may comprise one or more hydroprocessing reactors 32, 34 and 36. The hydroprocessing reactors may comprise three hydroprocessing reactors comprising a first hydroprocessing reactor 32, a second hydroprocessing reactor 34 and a third hydroprocessing reactor 36. More or less hydroprocessing reactors may be used, and each hydroprocessing reactor 32, 34 and 36 may comprise a part of a hydroprocessing reactor vessel or comprise one or more hydroprocessing reactor vessels. Each hydroprocessing reactor 32, 34 and 36 may comprise part of a catalyst bed or one or more catalyst beds in one or more hydroprocessing reactor vessels. In the FIGURE, the first reactor train 12 comprises three hydroprocessing reactors 32, 34 and 36 each reactor comprising a single bed of hydroprocessing catalyst residing in a single reactor vessel.

The first reactor train 12 includes a first volume 31 of hydroprocessing catalyst in aggregate. In an aspect, the first volume 31 of catalyst is aggregately provided in at least two separate reactors. In an embodiment, the first hydroprocessing reactor 32, the second hydroprocessing reactor 34 and the third hydroprocessing reactor 36 contain the first volume 31 of hydroprocessing catalyst distributed among the three reactors.

Suitable hydroprocessing catalysts for use in the first reactor train 12 are any conventional resid hydrotreating catalysts and include those which are comprised of at least one Group VIII metal, preferably iron, cobalt and nickel, more preferably nickel and/or cobalt and at least one Group VI metal, preferably molybdenum and tungsten, on a high surface area support material, preferably alumina. It is within the scope of the present invention that more than one type of hydrotreating catalyst be used in the same reaction vessel or catalyst bed. The Group VIII metal is typically present on the hydrotreating catalyst in an amount ranging from about 1 to about 10 wt %, preferably from about 2 to about 5 wt %. The Group VI metal will typically be present on the hydrotreating catalyst in an amount ranging from about 1 to about 20 wt %, preferably from about 2 to about 10 wt %.

In an embodiment, the first hydroprocessing reactor 32, the second hydroprocessing reactor 34 and the third hydroprocessing reactor 36 may contain hydroprocessing catalyst comprising a resid hydrotreating catalyst comprising cobalt and molybdenum on gamma alumina. The resid hydrotreating catalyst in the first hydroprocessing reactor 32, the second hydroprocessing reactor 34 and the third hydroprocessing reactor 36 may have a bimodal pore size distribution with at least about 25% of the pores on the catalyst particle being characterized as small pores, in the micropore or mesopore range of about 5 to no more than about 30 nm and at least about 25% of the pores being characterized as large pores, in the mesopore or macropore range of greater than about 30 to about 100 nm. The large pores are more suited for hydrodemetallation and the small pores are more suited for hydrodesulfurization. The ratio of large pores to small pores may decrease from upstream to downstream in the first hydroprocessing reactor 32, the second hydroprocessing reactor 34 and the third hydroprocessing reactor 36 to provide a first large pore to small pore gradient and a first overall ratio of large pores to small pores. In an aspect, the first hydroprocessing reactor 32 will have a larger ratio of large pores to small pores than the second hydroprocessing reactor 34. In a further aspect, the second hydroprocessing reactor 34 will have a larger ratio of large pores to small pores than the third hydroprocessing reactor 36.

In the first condition, the first reactor train 12 receives the mixed hydrocarbon stream from the mixed hydrocarbon line 24. The first reactor train 12 is fluidly connected to the first hydrocarbon feed line 28 through the first train inlet line 29, so the first reactor train 12 is in downstream communication with the first hydrocarbon feed line 28, the hydrocarbon split 26 and the mixed hydrocarbon line 24. The mixed hydrocarbon stream in the first hydrocarbon feed line 28 may be fed to the first hydroprocessing reactor 32, the second hydroprocessing reactor 34 and the third hydroprocessing reactor 36. The first hydroprocessing reactor 32, the second hydroprocessing reactor 34 and the third hydroprocessing reactor 36 may be arranged in series such that the effluent from one cascades into the inlet of the other. It is contemplated that more or less hydroprocessing reactors may be provided in the first reactor train 12. The first hydroprocessing reactor 32, the second hydroprocessing reactor 34 and the third hydroprocessing reactor 36 are intended to hydrotreat the mixed, hydrocarbon stream, so as to reduce the metals concentration in the fresh feed stream by about 40 to about 90 wt % to produce a hydroprocessed effluent stream exiting one, some or all of the first hydroprocessing reactor 32, the second hydroprocessing reactor 34 and the third hydroprocessing reactor 36. The metal content of the hydroprocessed resid stream may be less than about 50 wppm and preferably between about 1 and about 25 wppm. The first hydroprocessing reactor 32, the second hydroprocessing reactor 34 and the third hydroprocessing reactor 36 may also desulfurize, deasphalt and denitrogenate the hydrocarbon mixed feed stream to reduce the sulfur concentration in the fresh feed stream typically by about 65 to about 95 wt % and reduce coke asphaltene concentration in the fresh feed stream by about 40 to about 90 wt %. A first hydroprocessed stream reduced in organic metals, nitrogen and sulfur concentration relative to the mixed hydrocarbon feed stream fed to the first reactor train 12 may exit the first reactor train 12 comprising the first hydroprocessing reactor 32, the second hydroprocessing reactor 34 and the third hydroprocessing reactor 36 in a first train outlet line 37.

Preferred reaction conditions in each of the first hydroprocessing reactor 32, the second hydroprocessing reactor 34 and the third hydroprocessing reactor 36 include a temperature from about 66° C. (151° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig) to about 27.6 MPa (gauge) (4000 psig), preferably about 13.8 MPa (gauge) (2000 psig) to about 20.7 MPa (gauge) (3000 psig), a liquid hourly space velocity of the fresh resid feed from about 0.1 $hr^{-1}$ to about 5 $hr^{-1}$, preferably from about 0.2 to about 2 $hr^{-1}$, and a hydrogen rate of about 168 $Nm^3/m^3$ (1,000 scf/bbl) to about 1,680 $Nm^3/m^3$ oil (10,000 scf/bbl), preferably about 674 $Nm^3/m^3$ oil (4,000 scf/bbl) to about 1,011 $Nm^3/m^3$ oil (6,000 scf/bbl).

In the first condition, the first hydroprocessed effluent stream may exit the first reactor train 12 through the third hydroprocessing reactor 36 or whichever hydroprocessing reactor 32, 34, 36 is the last on stream in the first reactor train 12 in the first train outlet line 37. A control valve on the first depleted sulfide oil exit line 39 is closed to prevent the first hydroprocessed effluent stream from exiting the first train outlet line 37 into the sulfide section 108 during the first condition before termination of the first condition. A control valve on the first hydroprocessed effluent line 38 is open in the first condition to allow first hydroprocessing effluent stream from the first train outlet line 37 to pass through the first hydroprocessed effluent line 38 to the separation section 31 while in the first condition.

The first reactor train 12 of hydroprocessing reactors 32, 34 and 36 may process a hydrocarbon feed such as resid which is highly concentrated in metals and sulfur. Therefore, the hydroprocessing catalyst may become deactivated rapidly and require regeneration or replacement with fresh hydroprocessing catalyst. To regenerate or replace catalyst, the feed of the mixed hydrocarbon feed stream to the first reactor train 12 comprising the first volume 31 of hydroprocessing catalyst is terminated by closing the valves on the first hydrocarbon feed line 28 and the first hydroprocessed effluent line 38 terminating the first condition. During isolation of the first catalyst train 12, the first catalyst volume 31 can be replaced or regenerated. In a resid hydroprocessing unit, catalyst is typically replaced.

For example, the first reactor train 12 may require termination of the first condition taking it off-stream once a year; whereas, the downstream FCC unit may have a continuous cracking period of five years during which no shut down is required until after five years. However, to keep hydroprocessed hydrocarbon feed flowing to the downstream FCC unit 18, the mixed hydrocarbon stream may be diverted to the second reactor train 16 comprising a second volume 102 of hydroprocessing catalyst that is smaller than the first volume 31 of catalyst in the first reactor train 12 while in a second condition. Consequently, the space velocity through the second reactor train 16 comprising the second volume 102 of catalyst is greater than the space velocity through the first reactor train 12 comprising the first volume 31 of catalyst due to the hydrocarbon feed flow rate being the same through both reactor trains 12, 16 and the catalyst volume and mass being larger in the first reactor train 12.

In the second condition, the valves on the second hydrocarbon feed line 30 and the second hydroprocessed effluent line 104 are open; whereas, the valves on the first hydrocarbon feed line 28 and the first hydroprocessed effluent line 38 are closed. The second train inlet 101 receives the mixed hydrocarbon feed stream from the hydrocarbon split 26 and the second hydrocarbon feed line 30 and feeds it to the second reactor train 16. Because the first volume 31 of catalyst is larger than the second volume 102 of catalyst, the duration of the first condition in which the mixed hydrocarbon stream is fed to the first volume 31 of hydroprocessing catalyst in the first reactor train 12 endures for a longer period of time than the second condition in which the mixed hydrocarbon stream is fed to the second volume 102 of catalyst in the second reactor train 16.

The fluid catalytic cracking unit 18 can be operated for a continuous cracking period without a shut down. In the first condition, the mixed hydrocarbon stream in the first hydrocarbon feed line 28 is fed to the first volume 31 of hydroprocessing catalyst in the first reactor train 12 for a first hydroprocessing period until termination during the continuous cracking period. The first hydroprocessing period is shorter than the continuous cracking period. In the second condition, the mixed hydrocarbon stream in the second hydrocarbon feed line 30 is fed to the second volume 102 of hydroprocessing catalyst in the second reactor train 16 for a second hydroprocessing period until termination during the continuous cracking period. The second hydroprocessing period is shorter than the first hydroprocessing period and the continuous cracking period. For example, the first hydroprocessing period may be about 10 to about 12 months, the second hydroprocessing period may be about 20 to about 40 days. The continuous cracking period may be about 4 to about 6 years.

The second reactor train 16 may comprise one or more hydroprocessing reactors 100. Each hydroprocessing reactor 100 may comprise part of a catalyst bed or one or more catalyst beds in one or more hydroprocessing reactor vessels. In the second reactor train 16, the second volume 102 of catalyst is provided in a single reactor 100. In the FIGURE, the second reactor train 16 comprises a single, fourth hydroprocessing reactor 100 comprising a single bed of hydroprocessing catalyst in a single reactor vessel. The fourth hydroprocessing reactor 100 may comprise more or less hydroprocessing reactors and each hydroprocessing reactor 100 may comprise a part of a hydroprocessing reactor vessel or comprise one or more hydroprocessing reactor vessels.

The ratio of large pores to small pores may decrease from upstream to downstream in the second reactor train 16 and particularly the fourth hydroprocessing reactor 100 to provide a second large pore to small pore gradient and a second overall ratio of large pores to small pores in the second reactor train 16. The second large pore to small pore gradient and a second overall ratio of large pores to small pores in the second volume 102 of catalyst in the second reactor train 16 may be the same as or similar to the first large pore to small pore gradient and the first overall ratio of large pores to small pores for the first volume 31 of catalyst in the first reactor train 12. The first reactor train 12 has a greater first volume of catalyst than the second volume of catalyst in the second reactor train 16 and preferably has more reactor vessels than in the second reactor train 16.

In the second condition, the second reactor train 16 receives the mixed hydrocarbon stream from the mixed hydrocarbon line 24. The second reactor train 16 is fluidly connected to the second hydrocarbon feed line 30, so the second reactor train 16 is in downstream communication with the second hydrocarbon feed line 30, the hydrocarbon split 26 and the mixed hydrocarbon line 24. The mixed hydrocarbon stream in the second hydrocarbon feed line 30 may be fed to the fourth hydroprocessing reactor 100. The fourth hydroprocessing reactor 100 is intended to hydrodemetallize the heated hydrocarbon stream, so to reduce the metals concentration in the fresh feed stream by about 40 to about 90 wt % to produce a hydrotreated effluent stream exiting the fourth hydroprocessing reactor 100. The metal content of the hydrotreated hydrocarbon stream may be less than about 50 wppm and preferably between about 1 and about 25 wppm. The fourth hydroprocessing reactor 100 may also desulfurize, deasphalt and denitrogenate the mixed hydrocarbon stream to reduce the sulfur concentration in the fresh feed stream typically by about 65 to about 95 wt % and reduce asphaltene concentration in the fresh feed stream by about 40 to about 90 wt %. A second hydroprocessed stream reduced in metals and sulfur concentration relative to the mixed hydrocarbon feed stream fed to the second reactor train 16 may exit the fourth hydroprocessing reactor 100 in the second reactor train 16 in a second train outlet line 103.

Preferred reaction conditions in the fourth hydroprocessing reactor 100 are generally in the same range as in the first hydroprocessing reactor 32, the second hydroprocessing reactor 34 and the third hydroprocessing reactor 36. However, because the second reactor train has to hydroprocess the same amount of feed over a smaller volume of catalyst, the pressure and/or temperature of the second reactor train 16 will be greater than in the first reactor train 12. In other words, the temperature and/or pressure profile throughout the second hydroprocessing period in the second reactor train 16 will be higher than throughout the first hydroprocessing period in the first reactor train 12.

The second hydroprocessed effluent stream may exit the fourth hydroprocessing reactor 100 in the second train outlet line 103. In the second condition, a control valve on a second hydroprocessing effluent line 104 is open to allow the second hydroprocessed effluent stream to pass from the second train outlet line 103 to the second hydroprocessing effluent line 104 when the control valve on the second hydrocarbon line 30 is open. In the second condition, a control valve on a second depleted sulfide oil exit line 106 is closed to prevent the second hydroprocessed effluent stream from entering the sulfiding section 108.

The second reactor train 16 of the hydroprocessing reactor 100 may process a hydrocarbon feed such as resid which is highly concentrated in metals and sulfur. Therefore, the hydroprocessing catalyst may become deactivated rapidly and require regeneration or replacement with fresh hydroprocessing catalyst. To regenerate or replace catalyst, the feed of the mixed hydrocarbon feed stream to the second reactor train 16 comprising the second volume 102 of hydroprocessing catalyst is terminated by closing the valves on the second hydrocarbon feed line 30 and the second hydroprocessed effluent line 104. During isolation of the second catalyst train 16, the second catalyst volume 102 can be replaced or regenerated. In a resid hydroprocessing unit, catalyst is typically replaced.

To keep hydroprocessed hydrocarbon feed flowing to the downstream FCC unit 18, the process and apparatus 10 may be switched back to the first condition in which the mixed hydrocarbon stream is diverted back to the first reactor train 12 comprising the first volume 31 of hydroprocessing catalyst that is larger than the second volume 102 of hydroprocessing catalyst in the second reactor train 16 by opening the valves on the first hydrocarbon feed line 28 and the first hydroprocessed effluent line 38. The cycle between the first condition and the second condition can be repeated indefinitely or at least until the FCC unit 18 must be shut down after which all cycles can be repeated.

When the control valve on the first hydroprocessed effluent line 38 is opened and the control valve on the first depleted sulfide oil exit line 39 is closed while in the first condition, the first hydroprocessed effluent stream is received at a joinder 107. When the control valve on the second hydroprocessed effluent line 104 is opened and the control valve on the second sulfide oil exit line 106 is closed while in the second condition, the second hydroprocessed effluent stream is received at the joinder 107. The joinder 107 fluidly connects the first hydroprocessed effluent line 38 and the second hydroprocessed effluent line 104 to a common hydroprocessed effluent line 109. The common hydroprocessed effluent line 109 carries the first hydroprocessed effluent stream or the second hydroprocessed effluent stream, as the condition may be, to be cooled by heat exchange with the hydrocarbon stream in line 20 and enter the separation section 14.

The separation section 14 comprises one or more separators in downstream communication with the first reactor train 12 and the second reactor train 16 including a hot separator 40. The first hydroprocessed effluent line 38 delivers a cooled hydroprocessed effluent stream to the hot separator 40. Accordingly, the hot separator 40 is in downstream communication with the first hydroprocessing reactor 32, the second hydroprocessing reactor 34 and the third hydroprocessing reactor 36. The hot separator 40 separates the first hydroprocessed stream in the first hydroprocessed effluent line 38 while in the first condition before termination and separates the second hydroprocessed hydrocarbon stream in the second hydroprocessed effluent line 104 while in the second condition after termination of the first condition and before termination of the second condition.

The hot separator 40 separates the first hydroprocessed stream to provide a hot vapor stream in a hot overhead line 42 and a hydrocarbonaceous hot liquid stream in a hot bottoms line 44. The hot vapor stream comprises the bulk of the hydrogen sulfide from the demetallized and desulfurized first hydroprocessed effluent stream. The hot liquid stream has a smaller concentration of hydrogen sulfide than the first hydroprocessed stream.

The hot separator 40 may operate at about 177° C. (350° F.) to about 371° C. (700° F.) and preferably operates at about 232° C. (450° F.) to about 315° C. (600° F.). The hot separator 40 may be operated at a slightly lower pressure than the hydroprocessing reactors 32, 34, 36 and 100 accounting for pressure drop through intervening equipment. The hot separator 40 may be operated at pressures between about 3.4 MPa (gauge) (493 psig) and about 20.4 MPa (gauge) (2959 psig). The hot vapor stream in the hot overhead line 42 may have a temperature of the operating temperature of the hot separator 40. The hot liquid stream in the first hot bottoms line 44 may be directed to a stripping column 50.

The hot vapor stream in the hot overhead line 42 may be cooled before entering a cold separator 60. The cold separator 60 may be in downstream communication with the hot overhead line 42.

As a consequence of the reactions taking place in the first reactor train 12 and the second reactor train 16 wherein nitrogen, and sulfur are reacted from the feed, ammonia and hydrogen sulfide are formed. The hot separator 40 removes the hydrogen sulfide and ammonia from the hot liquid stream before exiting in the hot bottoms line 44 and transfers it into the hot vapor stream in the hot overhead line 42 to provide a sweetened, demetallized and desulfurized stream for further processing such as in the FCC unit 18.

To prevent deposition of ammonium bisulfide salts in the hot overhead line 40 transporting the hot vapor stream, a suitable amount of wash water may be introduced into the first hot overhead line 42 by a water wash line.

The cooled first stage vapor stream may be separated in the cold separator 60 to provide a cold vapor stream comprising a hydrogen-rich gas stream including ammonia and hydrogen sulfide in a cold overhead line 62 and a cold liquid stream in a cold bottoms line 64.

The cold separator 60 serves to separate hydrogen rich gas from hydrocarbon liquid in the hot vapor stream for recycle to the first and the second reactor trains 12 and 16. The cold separator 60, therefore, is in downstream communication with the hot overhead line 42 of the hot separator 40.

The cold separator 60 may be operated at about 100° F. (38° C.) to about 150° F. (66° C.), suitably about 115° F. (46° C.) to about 145° F. (63° C.), and just below the pressure of the last hydroprocessing reactor 32, 34, 36 or 100 and the hot separator 40 accounting for pressure drop through intervening equipment to keep hydrogen and light gases in the overhead and normally liquid hydrocarbons in the bottoms. The cold separator 60 may be operated at pressures between about 3 MPa (gauge) (435 psig) and about 20 MPa (gauge) (2,901 psig). The cold separator 60 may also have a boot for collecting an aqueous phase. The cold liquid stream in the cold bottoms line 64 may have a temperature below the operating temperature of the cold separator 60. The cold liquid stream in the cold bottoms line 64 may be delivered to the stripper column 50, in an embodiment at a location higher than the hot liquid stream in the hot bottoms line 44. It is envisioned that the hot liquid stream in the hot bottoms line 44 and the cold liquid stream in the cold bottoms line 64 may be further reduced in pressure and separated in a flash drum before being delivered to the stripper column 50 and or that two stripper columns be used.

The cold vapor stream in the cold overhead line 62 is rich in hydrogen. Thus, hydrogen can be recovered from the cold vapor stream. However, this stream comprises much of the hydrogen sulfide and ammonia separated from the first hydroprocessed stream or the second hydroprocessed stream. The cold vapor stream in the cold overhead line 62 may be passed through a trayed or packed recycle scrubbing column 70 where it is scrubbed by means of a scrubbing extraction liquid such as an aqueous solution fed by line 72 to remove gases including hydrogen sulfide and ammonia by extracting them into the aqueous solution. Preferred aqueous solutions include lean amines such as alkanolamines including DEA, MEA, and MDEA. Other amines can be used in place of or in addition to the enumerated amines. The lean amine contacts the cold vapor stream and absorbs gas contaminants such as hydrogen sulfide and ammonia. The resultant "sweetened" cold vapor stream is taken out from an overhead outlet of the recycle scrubber column 70 in a recycle scrubber overhead line 74, and a rich amine is taken out from the bottoms at a bottom outlet of the recycle scrubber column in a recycle scrubber bottoms line 76. The spent scrubbing liquid from the bottoms may be regenerated and recycled back to the recycle scrubbing column 70 in line 72. The scrubbed hydrogen-rich stream emerges from the scrubber via the recycle scrubber overhead line 74 and is compressed to provide a recycle hydrogen gas stream in line 78. The recycle hydrogen gas stream may be supplemented with a first make-up hydrogen stream in a first make-up hydrogen line 80 taken from a make-up hydrogen line 82. The flow of the first make-up hydrogen stream in first make-up line 80 is regulated by a control valve thereon for supplying the hydrogen stream in the hydrogen line 22. The recycle scrubbing column 70 may be operated with a gas inlet temperature between about 38° C. (100° F.) and about 66° C. (150° F.) and an overhead pressure of about 3 MPa (gauge) (435 psig) to about 20 MPa (gauge) (2900 psig).

The cold liquid stream and the hot liquid stream may be stripped of gases in the stripping column 50 with a stripping media which is an inert gas such as steam from a stripping media line 52 to provide a stripper vapor stream of hydrogen, hydrogen sulfide, steam and other light gases in a stripper overhead line 54 and a stripped hydroprocessed stream in a stripper bottoms line 56. The stripper vapor stream in the stripper overhead line 54 may be condensed and separated in a receiver to provide the stripper vapor stream as a net stripper off gas. Unstabilized liquid naphtha from a side outlet from the stripper may be provided for further naphtha processing.

The stripping column 50 may be operated with a bottoms temperature between about 160° C. (320° F.) and about 360° C. (680° F.), and an overhead pressure of about 0.7 MPa (gauge) (100 psig), preferably no less than about 0.50 MPa (gauge) (72 psig), to no more than about 2.0 MPa (gauge) (290 psig). The temperature in the overhead line 54 ranges from about 38° C. (100° F.) to about 66° C. (150° F.).

The stripped hydroprocessed stream in the stripper bottoms line 56, which may comprise hydrodemetallized and hydrodesulfurized resid may be passed to the FCC unit 18. The FCC unit 18 is fluidly connected to the first reactor train 12 in the first condition with the valve on the first hydroprocessed effluent line 38 open and alternatively fluidly connected to the second reactor train 16 in the second condition when the valve on the second hydroprocessed effluent line 104 is open. In the FCC unit 18 a hydrocarbon stream taken from the stripper bottoms line 56 is contacted with a cracking catalyst for a continuous cracking period. The cracking catalyst may comprise a Y zeolite in a riser reactor vessel 90 to crack the stripped hydroprocessed stream to lighter fuel range hydrocarbons such as naphtha and distillate. Conditions in the riser reactor vessel 90 are atmospheric and between about 550 and about 650° C. Spent catalyst is separated from cracked products and transferred to a regenerator 92 in which coke on spent catalyst is combusted at about 700 to about 800° C. to regenerate the catalyst which is returned to the riser reactor vessel 90. Cracked product vapors are recovered in an FCC vapor line 94 which may be transferred to a main fractionation column to separate cracked product vapors into product streams including LPG, naphtha, diesel, LCO and slurry oil.

The first catalyst volume 31 and the second catalyst volume 102 must be sulfided after regeneration or replacement to prepare it for hydroprocessing feed. The sulfiding section 108 is utilized for sulfiding the first volume 31 of catalyst in the first reactor train 12 while in the second condition and sulfiding the second volume 102 of catalyst in the second reactor train 16 while in the first condition.

While in the first condition, flushing oil from a surge drum in flush line 110 receives an injection of a sulfiding agent which may comprise dimethyl disulfide (DMDS) or tertiary butyl polysulfide (TBPS) from a sulfide line 112 to achieve a sulfur concentration of about 1.0 wt % to about 2.0 wt % in a sulfide flush oil stream in a sulfide flush line 114. A sulfide hydrogen stream from a sulfide hydrogen line 116 is mixed with the sulfide flush oil to provide a mixed sulfide oil in a sulfide oil line 118. The mixed sulfide oil stream is heated in a furnace to a sulfiding temperature of about 145° C. (293° F.) to about 360° C. (680° F.), suitably about 180° C. (356° F.) to about 350° C. (662° F.) and preferably about 205° C. (400° F.) to about 315° C. (600° F.) and fed to a sulfide split 120. The temperature of the mixed sulfide oil stream may be held at particular temperatures and increased or decreased over time to achieve a desired temperature profile during the sulfiding process. The sulfide split 120 joins the mixed sulfide oil line 118 to a first sulfide oil line 122 and a second sulfide oil line 124.

A control valve on the second sulfide oil line 124 may be opened to allow the mixed sulfide oil stream to enter the second reactor train 16 through the second train inlet line 101 while the process and apparatus 10 are in the first condition before termination of the first condition. In the first condition, the control valve on the second hydrocarbon feed line 30 is closed, so as to not mix feed and sulfide oil. A control valve on the first sulfide oil line 122 is closed to prevent the mixed sulfide oil stream from entering the first hydroprocessing catalyst volume 31 through the first train inlet line 29 to the first reactor train 12 during the first condition before termination of the first condition. The sulfiding of the second volume of catalyst 102 in the second reactor train 16 does not take as long as the first hydroprocessing period, but it is necessary to activate the hydroprocessing catalyst to make it capable of catalyzing a hydroprocessing reaction. A sulfide depleted oil stream exits the second reactor train 16 in the second outlet line 103 while sulfiding in the first condition. In the first condition, the control valve on the second hydroprocessed effluent line 104 is closed and the control valve on the second depleted sulfide oil exit line 106 is open while sulfiding, so the depleted sulfide oil stream exits the second outlet line 103 through the second depleted sulfide oil exit line 106 and enters an oil separator inlet line 124 for delivery to an sulfide oil cold separator 126 after cooling. The sulfide oil cold separator 126 separates hydrogen sulfide-rich recycle gas in an oil overhead line 128 from a sulfide oil recycle stream exiting in an oil bottoms line 130.

The hydrogen sulfide rich recycle gas in the oil overhead line 128 is fed to a recycle compressor that provides compressed hydrogen sulfide rich recycle gas in compressed recycle line 132. The compressed hydrogen sulfide rich recycle gas is mixed with a second make-up hydrogen stream in a second make-up hydrogen line 84 taken from a make-up gas stream in make-up line 82. The second make-up hydrogen stream flow is regulated by a control valve on the second make-up hydrogen line to provide the sulfide hydrogen stream in the sulfide hydrogen line 116 which is mixed with the sulfide flush oil in the sulfide flush line 114. The sulfide oil recycle stream in the oil bottoms line 130 may be mixed with flushing oil in flush line 110 before or after the flush oil feed surge drum for further use.

While the process and apparatus 10 are in the second condition, replaced or regenerated catalyst volume 31 in the first reactor train 12 may be sulfided. To sulfide the first catalyst volume 31 in the first reactor train 12, the control valve on the first sulfide oil line 122 is opened to allow the mixed sulfide oil stream to enter the first reactor train 12 through the first train inlet line 29 before termination of the second condition. In the second condition, the control valve on the first hydrocarbon feed line 28 is closed and the control valve on the second hydrocarbon feed line 30 is open. A control valve on the second sulfide oil line 124 is closed to prevent the mixed sulfide oil stream from entering the second hydroprocessing catalyst volume 102 through the second train inlet line 101 to the second reactor train 16 during the second condition before termination of the second condition, so as to not mix hydrocarbon feed and sulfide oil. The sulfiding of the first volume of catalyst 31 in the first reactor train 12 does not take as long as the second hydroprocessing period, but it is necessary to activate the hydroprocessing catalyst to make it capable of catalyzing a hydroprocessing reaction. A sulfide depleted oil stream exits the first reactor train 12 in the first outlet line 37 while sulfiding in the second condition. In the second condition, the control valve on the first hydroprocessed effluent line 38 is closed and the control valve on the first depleted sulfide oil exit line 39 is open, so the depleted sulfide oil stream exits the first outlet line 37 through the first depleted sulfide oil exit line 39 and enters the oil separator inlet line 124 for delivery to the sulfide oil cold separator 126 after cooling. The sulfide oil cold separator 126 separates hydrogen sulfide rich recycle gas in an oil overhead line 128 from a sulfide oil recycle stream exiting in an oil bottoms line 130 and the sulfide section 108 is ready to sulfide the first reactor volume 31 during sulfiding in the first condition.

SPECIFIC EMBODIMENTS

While the following is described in conjunction with specific embodiments, it will be understood that this description is intended to illustrate and not limit the scope of the preceding description and the appended claims.

A first embodiment of the invention is a process for hydroprocessing a hydrocarbon stream comprising feeding the hydrocarbon stream and a hydrogen stream to a first volume of hydroprocessing catalyst to hydroprocess the hydrocarbon stream in the presence of the hydrogen stream to provide a first hydroprocessed stream; terminating feed of the hydrocarbon stream to the first volume of catalyst; and feeding the hydrocarbon stream and the hydrogen stream to a second volume of hydroprocessing catalyst, second volume being smaller than the first volume of catalyst to hydroprocess the hydrocarbon stream in the presence of the hydrogen stream to provide a second hydroprocessed stream. An embodiment of the invention is one, any or all of prior embodiments in this paragraph up through the first embodiment in this paragraph wherein the first volume of catalyst is aggregately provided in at least two separate reactors and the second volume of catalyst is provided in a single reactor. An embodiment of the invention is one, any or all of prior embodiments in this paragraph up through the first embodiment in this paragraph wherein the first feeding step to the first volume of catalyst endures for a longer time than the second feeding step to the second volume of catalyst. An embodiment of the invention is one, any or all of prior embodiments in this paragraph up through the first embodiment in this paragraph further comprising feeding the first hydroprocessed stream to a fluid catalytic cracking reactor before the termination step and feeding the second hydroprocessed hydrocarbon stream to the fluid catalytic cracking reactor after the termination step. An embodiment of the invention is one, any or all of prior embodiments in this paragraph up through the first embodiment in this paragraph further comprising operating the fluid catalytic cracking unit for a continuous cracking period without a shut down. An embodiment of the invention is one, any or all of prior embodiments in this paragraph up through the first embodiment in this paragraph further comprising feeding the hydrocarbon stream and the hydrogen stream to the first volume of hydroprocessing catalyst for a first hydroprocessing period up to the termination step that is shorter than the continuous cracking period and the termination step is during the cracking period. An embodiment of the invention is one, any or all of prior embodiments in this paragraph up through the first embodiment in this paragraph further comprising feeding a sulfide oil comprising a sulfiding agent to the second volume of catalyst before the termination step and feeding the sulfide oil comprising the sulfiding agent to the first volume of catalyst after the termination step. An embodiment of the invention is one, any or all of prior embodiments in this paragraph up through the first embodiment in this paragraph further comprising separating the first hydroprocessed stream in a separator before the termination step and separating the second hydroprocessed hydrocarbon stream in the separator after the termination step. An embodiment of the invention is one, any or all of prior embodiments in this paragraph up through the first embodiment in this paragraph further comprising stripping a liquid hydrocarbon stream from the separation step and passing the stripped liquid hydrocarbon stream to a fluid catalytic cracking reactor. An embodiment of the invention is one, any or all of prior embodiments in this paragraph up through the first embodiment in this paragraph further comprising terminating feed of the hydrocarbon stream to the second volume of catalyst and repeating the steps of the first embodiment of this paragraph. An embodiment of the invention is one, any or all of prior embodiments in this paragraph up through the first embodiment in this paragraph wherein the first volume of catalyst is provided in more reactor vessels than the second volume of catalyst. An embodiment of the invention is one, any or all of prior embodiments in this paragraph up through the first embodiment in this paragraph wherein the second volume of catalyst and the first volume of catalyst have the same ratio of large pores to small pores on the hydroprocessing catalyst.

A second embodiment of the invention is an apparatus for converting a hydrocarbon stream comprising a feed line for carrying a hydrocarbon stream; a hydrocarbon split in the feed line joined to a first hydrocarbon feed line and a second hydrocarbon feed line; a first reactor train fluidly connected to the first hydrocarbon feed line; a second reactor train fluidly connected to the second feed line, wherein the first reactor train comprises more reactor volume than the second reactor train. An embodiment of the invention is one, any or all of prior embodiments in this paragraph up through the second embodiment in this paragraph further comprising a first control valve on the first hydrocarbon feed line and a second control valve on the second hydrocarbon feed line. An embodiment of the invention is one, any or all of prior embodiments in this paragraph up through the second embodiment in this paragraph further comprising a sulfiding agent line for carrying a sulfiding agent; a sulfide split in the sulfiding agent line joined to a first sulfiding line and a second sulfiding line; the first reactor train connected to the first sulfiding line; and the second reactor train connected to the second sulfiding line. An embodiment of the invention is one, any or all of prior embodiments in this paragraph up through the second embodiment in this paragraph further comprising a fluid catalytic cracking reactor fluidly connected to the first reactor train and alternatively fluidly connected to the second reactor train.

A third embodiment of the invention is a process for hydroprocessing a hydrocarbon stream comprising feeding the hydrocarbon stream and a first hydrogen stream to a first hydroprocessing reactor comprising a hydroprocessing catalyst to hydroprocess the hydrocarbon stream in the presence of the hydrogen stream to provide a first hydroprocessed stream; feeding a flushing oil comprising a sulfiding agent and a second hydrogen stream to a second hydroprocessing reactor to sulfide a hydroprocessing catalyst in a second hydroprocessing reactor; terminating feed of the hydrocarbon stream and the first hydrogen stream to the first hydroprocessing reactor; terminating feed of the flushing oil and the second hydrogen stream to the second hydroprocessing reactor; feeding the hydrocarbon stream and the first hydrogen stream to the second hydroprocessing reactor to hydroprocess the hydrocarbon stream in the presence of the first hydrogen stream to provide a second hydroprocessed stream; and feeding the flushing oil comprising a sulfiding agent and the second hydrogen stream to the first hydroprocessing reactor to sulfide a hydroprocessing catalyst in the first hydroprocessing reactor.

An embodiment of the invention is one, any or all of prior embodiments in this paragraph up through the third embodiment in this paragraph further comprising terminating feed of the hydrocarbon stream and the first hydrogen stream to the second reactor and terminating feed of the flushing oil and the second hydrogen stream to the first hydroprocessing reactor and repeating the steps of the third embodiment of this paragraph. An embodiment of the invention is one, any or all of prior embodiments in this paragraph up through the third embodiment in this paragraph further comprising feeding the first hydroprocessed hydrocarbon stream to a fluid catalytic cracking reactor before the termination step and feeding the second hydroprocessed hydrocarbon stream to the fluid catalytic cracking reactor after the termination step. An embodiment of the invention is one, any or all of prior embodiments in this paragraph up through the third embodiment in this paragraph wherein the first reactor comprises one or more first reactors containing a first reactor volume and the second reactor comprises one or more second reactors containing a second reactor volume and the first reactor volume is larger than the second reactor volume.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for hydroprocessing a hydrocarbon stream comprising:

feeding said hydrocarbon stream and a hydrogen stream to a first volume of hydroprocessing catalyst to hydroprocess said hydrocarbon stream in the presence of said hydrogen stream to provide a first hydroprocessed stream; terminating feed of said hydrocarbon stream to said first volume of catalyst; and feeding said hydrocarbon stream and said hydrogen stream to a second volume of hydroprocessing catalyst, said second volume being smaller than said first volume of catalyst to hydroprocess said hydrocarbon stream in the presence of said hydrogen stream to provide a second hydroprocessed stream, wherein said first hydroprocessed stream is fed to a fluid catalytic cracking reactor before said termination step and feeding said second hydroprocessed hydrocarbon stream to said fluid catalytic cracking reactor after said termination step.

2. The process of claim 1 wherein said first volume of catalyst is aggregately provided in at least two separate reactors and said second volume of catalyst is provided in a single reactor.

3. The process of claim 1 wherein said first feeding step to said first volume of catalyst endures for a longer time than said second feeding step to said second volume of catalyst.

4. The process of claim 1 further comprising operating the fluid catalytic cracking unit for a continuous cracking period without a shut down.

5. The process of claim 4 further comprising feeding said hydrocarbon stream and said hydrogen stream to said first volume of hydroprocessing catalyst for a first hydroprocessing period up to said termination step that is shorter than said continuous cracking period and said termination step is during said cracking period.

6. The process of claim 1 further comprising feeding a sulfide oil comprising a sulfiding agent to said second volume of catalyst before said termination step and feeding said sulfide oil comprising said sulfiding agent to said first volume of catalyst after said termination step.

7. The process of claim 1 further comprising separating said first hydroprocessed stream in a separator before said termination step and separating said second hydroprocessed hydrocarbon stream in said separator after said termination step.

8. The process of claim 7 further comprising stripping a liquid hydrocarbon stream from said separation step and passing said stripped liquid hydrocarbon stream to a fluid catalytic cracking reactor.

9. The process of claim 1 further comprising terminating feed of said hydrocarbon stream to said second volume of catalyst and repeating the steps of claim 1.

10. The process of claim 1 wherein said first volume of catalyst is provided in more reactor vessels than said second volume of catalyst.

11. The process of claim 1 wherein said second volume of catalyst and said first volume of catalyst have the same ratio of large pores to small pores on the hydroprocessing catalyst.

* * * * *